United States Patent [19]

Edo

[11] Patent Number: 4,513,719

[45] Date of Patent: Apr. 30, 1985

[54] FUEL INJECTOR

[75] Inventor: Teruo Edo, Oyama, Japan

[73] Assignee: Kabushiki Kaisha Komatsu Seisakusho, Tokyo, Japan

[21] Appl. No.: 534,889

[22] Filed: Sep. 22, 1983

[30] Foreign Application Priority Data

Sep. 22, 1982 [JP] Japan ..... 57-142606[U]

[51] Int. Cl.[3] ..... F02M 47/02

[52] U.S. Cl. ..... 123/447; 239/96

[58] Field of Search ..... 123/447, 446; 239/96

[56] References Cited

U.S. PATENT DOCUMENTS

| | | | |
|---|---|---|---|
| 2,959,360 | 11/1960 | Nichols | 239/96 |
| 3,568,646 | 3/1971 | Heidelberg | 123/447 |
| 4,080,942 | 3/1978 | Vincent et al. | 123/447 |
| 4,161,161 | 7/1979 | Bastenhof | 123/447 |

FOREIGN PATENT DOCUMENTS

| | | | |
|---|---|---|---|
| 56-94854 | 7/1981 | Japan . | |
| 212362 | 12/1982 | Japan | 123/447 |
| 638537 | 6/1950 | United Kingdom | 123/447 |
| 2099078 | 12/1982 | United Kingdom | 123/447 |

*Primary Examiner*—Magdalen Y. C. Moy

*Attorney, Agent, or Firm*—Armstrong, Nikaido, Marmelstein & Kubovcik

[57] ABSTRACT

A fuel injector of the accumulator type for use in an internal combustion engine which has a primary accumulator chamber and an auxiliary one. These accumulator chambers are connected through check valves with each other. The fuel injector is constructed such that the timing of fuel injection through an injection nozzle can be always kept constant regardless of the quantity of fuel under a high pressure to be supplied into the primary accumulator chamber which varies in response to the load on the engine.

3 Claims, 1 Drawing Figure

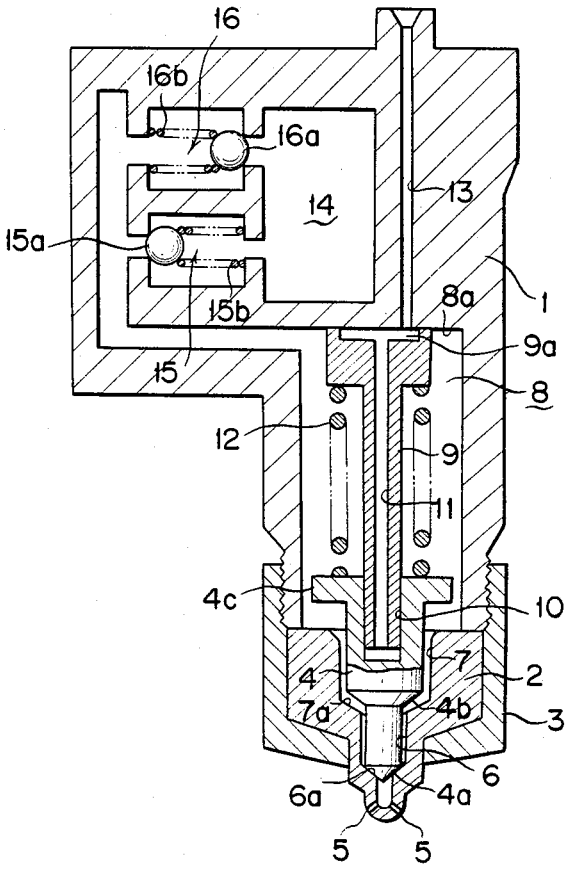
16
16b
16a
14
13
15a
15b
15
8a
1
9a
8
12
9
11
4c
10
7
2
4
7a
4b
3
6
6a
4a
5
5

FUEL INJECTOR

BACKGROUND OF THE INVENTION

1. Field of the Invention

This invention relates to a fuel injector for use in internal combustion engines, and more particularly to an accumulator type fuel injector.

2. Description of the Prior Art

Fuel injection through injectors having a spring biased or loaded nozzle valve capable of opening inwardly has been much improved by the provision of a fuel accumulator chamber formed within the injector body.

Fuel injectors of accumulation type have so far been developed. For example, in the specification of U.S. Pat. No. 2,959,360 by William M. Nichols, there is disclosed a fuel injector having a spring loaded nozzle valve capable of opening inwardly and a fuel accumulator chamber formed within the body thereof. Further, a similar fuel injector is disclosed in Japanese uitlity model application laid-open publication (provisional publication) No. Sho 56-94854 provisionally published on July 28, 1981. These fuel injectors are constructed such that, upon completion of the supply of fuel under high pressure into an accumulator chamber, a spring loaded needle valve is moved by the fuel under high pressure against the force of the spring to allow the fuel under high pressure within the accumulator chamber to be injected through injection orifices into the combustion chamber of the engine.

The above-mentioned fuel injectors have however been disadvantageous as mentioned below since the volume of an accumulator chamber formed in their bodies is always kept constant. Stating briefly, fuel under a predetermined high pressure is supplied by a Bosch type fuel injection pump etc. at a volume proportional to the load on the engine into the accumulator chamber so that when the engine is running at a high load, a large quantity of fuel under high pressure can be supplied into the accumulator chamber, whilst when the engine is running at a low load, a small quantity of pressurized fuel can be supplied into the accumulator chamber. Accordingly, when the engine is running at a high load, the pressure in the accumulator chamber rises rapidly with the result that the needle valve will move quickly, because the volume of the accumulator chamber is always kept constant. Whilst, when the engine is running at a low load, the pressure within the accumulator chamber rises slowly, and therefore the needle valve will move slowly by the same reason.

As described above, it is not preferable that the timing of injection of fuel under high pressure through injection orifices of the fuel injector into the combustion chamber of the engine varies depending on the load on the engine. Further, in such a case, when the quantity of fuel under high pressure supplied into the accumulator chamber is minimum, it is not always possible to actuate the needle valve properly, and in many cases it becomes difficult to obtain a minimum amount of fuel to be injected into the combustion chamber of the engine.

SUMMARY OF THE INVENTION

The present invention has been contemplated in view of the above-mentioned circumstances and has for its object to provide a fuel injector for use in an internal combustion engine constructed such that the timing of fuel injection through an injection nozzle can be always kept constant regardless of the quantity of fuel under a high pressure to be supplied into the accumulator chamber which varies in response to the load on the engine.

Another object of the present invention is to provide a fuel injector for use in internal combustion engines arranged such that even when the quantity of fuel under high pressure supplied into the accumulator chamber is minimum, the needle valve can be moved properly to ensure that a minimum quantity of fuel is injected in the combustion chamber of the engine.

To achieve the aforementioned objects, according to the present invention, there is provided a fuel injector for use in internal combustion engines which has a nozzle means provided with injection orifices formed in the leading end thereof and a spring loaded nozzle valve capable of opening inwardly and a fuel accumulator chamber, said nozzle valve being adapted to be moved inwardly by the pressure of the fuel supplied under pressure into the accumulator chamber to allow the fuel to be injected through the injection orifices into the combustion chamber of the engine, characterized by comprising an auxiliary accumulator chamber which communicates through first and second check valve means with said primary accumulator chamber.

Further, according to the present invention, there is provided a fuel injector for use in internal combustion engines characterized in that the fuel injector is constructed such that when the pressure of the fuel under high pressure supplied into the accumulator chamber exceeds a predetermined valve, the first check valve is actuated to allow the fuel under high pressure to flow into said auxiliary accumulator chamber, whilst when the supply of fuel under high pressure is interrupted and said nozzle valve is moved inwardly by the pressure of the fuel under high pressure within the accumulator chamber to inject the fuel under high pressure, the second check valve is actuated to allow the fuel under high pressure within said auxiliary accumulator chamber to flow into the primary accumulator chamber.

Still further, according to the present invention, there is provided a fuel injector for use in internal combustion engines characterized in that the volume of said auxiliary accumulator chamber is larger than that of the primary accumulator chamber.

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

BRIEF DESCRIPTION OF THE DRAWINGS

The accompany drawing shows sectional view of one embodiment of a fuel injector of the present invention.

DETAILED DESCRIPTION OF THE INVENTION

The present invention will now be described in detail below with reference to the accompanying drawing.

Fixedly secured to a nozzle body 1 by means of a cap nut 3 is a nozzle body 2 which has injection orifices 5 formed in the leading end thereof and which are adapted to be opened and shut by a needle valve 4. The fuel injection orifices 5 are connected through a small diameter hole 6 and a large diameter hole 7 with a primary accumulator chamber 8 formed in the aforementioned nozzle holder 1. The needle valve 4 has a leading end portion 4*a* adapted to be urged against a stepped portion 6*a* of the small diameter hole 6 and a downwardly directed stepped portion 4*b* located opposite to a stepped portion 7*a* of the large diameter hole 7. The upper part of the needle valve 4 projects into the main accumulator chamber 8 and has a flange 4*c* formed as an integral part thereof.

Reference numeral 9 denotes a rod-shaped member forming a check valve, the upper part of which is formed with a large diameter portion in which a recess 9*a* is formed, whilst the lower part of which is formed with a small diameter portion adapted to be fitted in a blind hole 10 of the needle valve 4. The rod shaped member 9 has a hole 11 extending along the longitudinal axis thereof and which opens into the recess 9*a*. The rod-shaped member 9 is urged against the upper wall 8*a* of the accumulator chamber 8 by the resilient force of a spring 12 forming a check valve. The nozzle holder 1 has a high pressure fuel supply hole 13 formed therein and leading to the aforementioned recess 9*a*. The pressurized fuel supply hole 13 is connected to means (not shown) for supplying fuel under a constant high pressure at an amount proportional to the load on the engine such as, for example, a Bosch type fuel injection pump, etc.

The above-mentioned nozzle holder 1 has an auxiliary accumulator chamber 14 formed therein and which has a volume larger than that of the primary accumulator chamber 8. The auxiliary accumulator chamber 14 is allowed to communicate through first and second check valves 15 and 16 with the primary accumulator chamber 8.

The first check valve 15 has a ball 15*a* and a spring 15*b*, whilst the second check valve 16 has a ball 16*a* and a spring 16*b*. The first check valve 15 controls the flow of the fuel into the auxiliary accumulator chamber 14, whilst the second check valve 16 controls the delivery of the fuel from the auxiliary accumulator chamber 14. The pressure set for the second check valve 16, i.e., the pressure required for delivering the fuel within the auxiliary accumulator chamber 14 is kept as small as possible so that when the needle valve 4 is pushed up the pressure in the primary accumulator chamber 8 is approximately equal to that in the auxiliary accumulator chamber 14.

The operation of the fuel injector according to the present invention will now be described below.

When the fuel under high pressure is supplied by a fuel injection pump (not shown) through a pipe (not shown) into the fuel supply part 13 and thence into the recess 9*a* of the rod-shaped member 9 thereby depressing the latter against the biasing force of the spring 12, the fuel under high pressure will flow into the main accumulator chamber 8.

When the engine is running at a high load or a large quantity of fuel under high pressure is supplied, the pressure in the primary accumulator chamber 8 becomes high enough to push the first check valve 15 open so as to supply the pressurized fuel also into the auxiliary accumulator chamber 14. Whilst, the engine is running at a low load or a small quantity of fuel under high pressure is supplied, the pressure in the primary accumulator chamber 8 cannot become high enough to push the first check valve 15 open, and so the fuel under high pressure is not allowed to flow into the auxiliary accumulator chamber 14.

When the supply of the fuel under high pressure into the supply hole 13 is interrupted, the rod shaped member 9 is moved upwards by the force of the spring 12 to interrupt the connection between the supply hole 13 and the primary accumulator chamber 8. At the same time, the biasing force of the spring 12 will reduce and the needle valve 4 will be moved upwards (inwardly) by the pressure of the fuel under high pressure within the primary accumulator chamber 8 so that the pressurized fuel in the chamber 8 may be injected through the injection orifices 5 into a combustion chamber (not shown).

At that time, the fuel under high pressure within the auxiliary accumulator chamber 14 will push the first check valve 16 open and flow into the primary accumulator chamber 8 so that it may be injected through the inection orifices 5.

To sum up, according to the fuel injector of the present invention, under a high load condition of the engine when a large quantity of fuel under high pressure is supplied the fuel is allowed to flow into both the primary accumulator chamber 8 and the auxiliary accumulator chamber 14 and so the volume of the accumulator chamber will increase, whilst under a low load condition where a reduced quantity of the fuel under high pressure is supplied, the fuel is allowed to flow into only the primary accumulator chamber 8 and therefore the volume of the accumulator chamber will reduce. In this manner, the volume of the accumulator chamber can be controlled or increased or reduced depending on the quantity of the fuel under high pressure to be supplied thereinto. Therefore, the pressure rise in the accumulator chamber when the fuel under high pressure is supplied therein can always be kept constant so that the timing of fuel injection through the injection orifices 5 can always be kept constant. Further even when the quantity of fuel under high pressure supplied into the accumulator chamber is minimum, the needle valve can be moved properly, and therefore the injection of a minimum quantity of fuel can be secured.

It is to be understood that the foregoing description is merely illustrative of a preferred embodiment of the present invention and that the present invention is not to be limited thereto, but is to be determined by the scope of the appended claims.

What is claimed is:

1. A fuel injector for use in internal combustion engines including a fuel injector body, a nozzle means provided with injection orifices formed on the leading end thereof, a primary fuel accumulator chamber in the body, and a spring loaded or biased nozzle valve capable of opening inwardly disposed in the primary fuel accumulator chamber, wherein when said nozzle valve is moved to its open position by the pressure of the fuel under high pressure in the primary accumulator chamber, the fuel in the latter is injected through the injection orifices into a combustion chamber of the engine, characterized by further comprising an auxiliary accumulator chamber connected through first and second check valve means with said primary accumulator chamber.

2. A fuel injector as claimed in claim 1 wherein when the pressure of the fuel under high pressure in said primary accumulator chamber exceeds a predetermined value, said first check valve means is actuated to allow the fuel under high pressure to flow into said auxiliary accumulator chamber, whilst when the supply of the fluid under high pressure is interrupted and said nozzle valve is moved inwardly by the pressure of the fuel under high pressure within the primary accumulator chamber thereby injecting the fuel, said second check valve means is actuated to allow the fuel under high pressure within said auxiliary accumulator chamber to be delivered into the primary accumulator chamber.

3. A fuel injector as claimed in claim 1 wherein the volume of said auxiliary accumulator chamber is larger than that of said primary accumulator chamber.

* * * * *